United States Patent [19]

Wolgamott et al.

[11] 4,266,620

[45] May 12, 1981

[54] HIGH PRESSURE FLUID APPARATUS

[76] Inventors: John E. Wolgamott, 2055 Ingalls, Edgewater, Colo. 80214; Gerald P. Zink, 0259 County Rd. 216, Durango, Colo. 81301

[21] Appl. No.: 120,709

[22] Filed: Feb. 11, 1980

[51] Int. Cl.[3] ..... E21B 21/02

[52] U.S. Cl. ..... 175/215; 173/58; 137/580

[58] Field of Search ..... 175/214, 215, 218; 173/58; 137/580

[56] References Cited

U.S. PATENT DOCUMENTS

| | | | |
|---|---|---|---|
| 3,155,179 | 11/1964 | Hunt . | |
| 3,750,749 | 8/1975 | Giroux | 175/218 |
| 3,987,963 | 10/1976 | Pacht | 237/124 |
| 4,168,753 | 9/1979 | Raibetanz | 175/218 |

*Primary Examiner*—William F. Pate, III

*Attorney, Agent, or Firm*—Jack E. Ebel; Stephen A. Gratton

[57] ABSTRACT

High pressure fluid apparatus having a swivel flow divider connected to a rotary power source and an accompanying power cylinder for transferring high pressure fluid from a stationary to a rotary medium and a fluid jet rotary bit. The swivel flow divider defines a pair of integral seal bearings which can be variably positioned by means of the power cylinder to divert substantially all of the fluid flow into a fluid conducting tube at high pressures, e.g. up to about 10,000 psi to about 20,000 psi to divert fluid flow to a relatively low pressure region surrounding the fluid conducting tube, or to apportion fluid flow between the tube and the low pressure region surrounding the tube. The fluid jet bit has a bit body including a wear resistant insert which can be removed from a fluid jet housing and mounting without subjecting fluid jet orifices secured in the latter to damage.

29 Claims, 9 Drawing Figures

HIGH PRESSURE FLUID APPARATUS

BACKGROUND OF THE INVENTION

1. Field of the Invention

The present invention relates to components utilized in high pressure fluid apparatus, and more particularly, to a swivel flow divider and a fluid jet bit for use in, for example, a portable rotary rock drill.

2. Description of the prior art.

High pressure fluid has been increasingly employed in industry for a myriad of uses, such as, inter alia, cleaning, cutting and drilling, which require transporting the fluid from stationary to rotary media. To handle high pressures, e.g. 10,000 psi to 20,000 psi, seals have been developed to substantially prevent fluid leakage in equipment.

However, these seals are conventionally fabricated from materials, such as, teflon or graphite, which have a relatively short useful life when subjected to high fluid pressures. In addition, these seals have a relatively complex construction, and thus, are expensive to manufacture. As the relative complex prior art high pressure equipment has numerous interrelated and complex component parts, more maintenance is required, and the removal and repair of each part is more complex.

Conventionally, pneumatic air-leg drills which utilize both rotary and percusive cutting action have been employed to drill relatively small diameter holes, for example, roof bolt holes, shot holes and exploratory holes, in soft to hard rock formations. One disadvantage of pneumatic air-leg drills is the weight thereof, e.g. 100 pounds, and, thus, the difficulty encountered in manually transporting and manipulating the drill and in "collaring" or starting a drill hole. The resultant holes are generally irregular, due to the percussive action of the drill and the difficulty encountered in manually maintaining drill alignment. Also, an extremely high level of noise is generated by an air-leg drill, and as such, health and safety hazards are created for drilling personnel. Conventional rock bits equipped with carbide inserts are utilized with pneumatic air-leg drills. Such conventional rock bits often become immovable in a drill hole due to, inter alia, drill cuttings or sloughing of drill hole walls, and the removal thereof is not only time consuming, but also poses a safety hazard.

Thus, a need exists for high pressure fluid apparatus utilized to transfer high pressure fluid from a stationary to a rotary medium, especially bearing(s) and seal(s), which is relatively simple in construction. More particularly, as need exists for a portable rotary rock drill utilized to drill relatively small diameter holes which is light weight and therefore, easily manipulated, which utilizes a unitary bearing and seal so as to divide fluid flow for drilling or flushing purposes and which utilizes a fluid jet bit to augment the rotary drilling action thereof.

BRIEF SUMMARY OF THE INVENTION

The present invention relates to high pressure fluid apparatus, for example, a portable rotary rock drill, having a swivel flow divider connected to a rotary power source and an accompanying power cylinder, for transporting high pressure fluid from a stationary to a rotary medium and a fluid jet rotary bit. The swivel flow divider defines a pair of integral seal bearings which can be variably positioned by means of the power cylinder to divert substantially all of the fluid flow into a fluid conducting tube at high pressures, e.g. up to about 10,000 to about 20,000 psi, to divert fluid flow to a relatively low pressure region juxtaposed to the fluid conducting tube, or to apportion fluid flow between the tube and the low pressure region juxtaposed to the tube. The fluid jet bit has a bit body including a wear resistant insert which can be removed from a fluid jet housing and mounting without subjecting fluid jet orifices secured in the latter to damage. The fluid jet bit as assembled shields fluid jets emanating from the fluid jet orifices to substantially the interface with the surface to be cut, and thus substantially prevents degradation of the fluid jets.

BRIEF DESCRIPTION OF THE DRAWINGS

The invention will be more readily understood by reference to the accompanying drawing wherein like reference numerals are utilized to indicate like elements throughout the drawing figures and in which.

DETAILED DESCRIPTION

Figure 1:
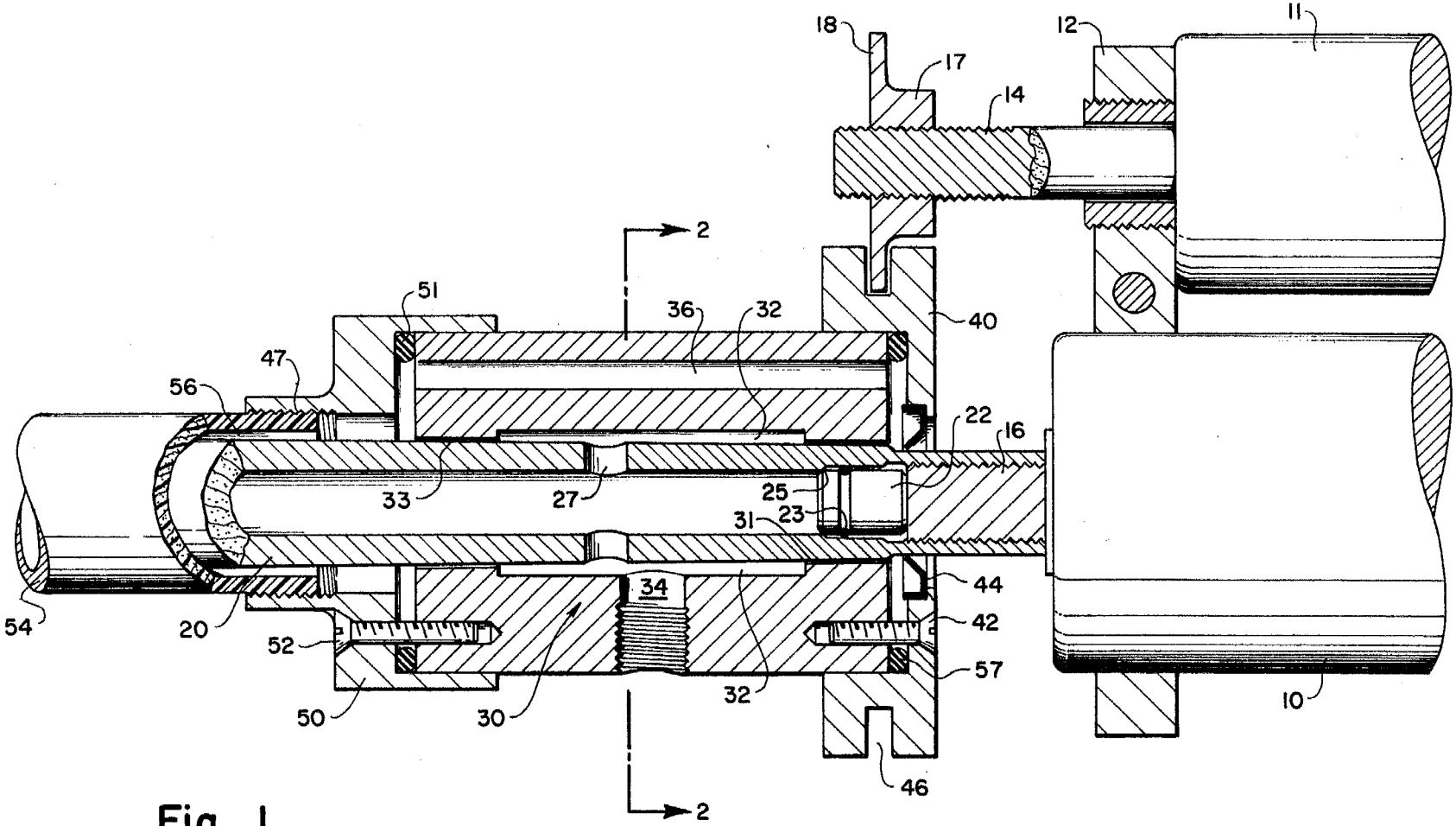
FIG. 1 is a sectional view of the swivel flow divider of the present invention connected to a rotary power source and an accompanying power cylinder.
Figure 2:
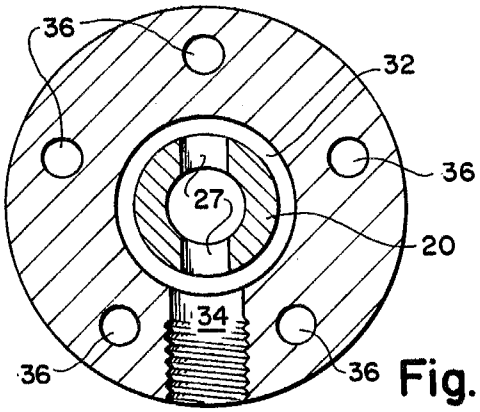
FIG. 2 is a cross sectional view of the swivel flow divider of the present invention taken along line 2—2 of FIG. 1.

As illustrated in FIG. 1, the side feed of swivel flow divider of the present invention is connected to a rotary power source and an accompanying power cylinder and functions to transfer high pressure fluid from a stationary to a rotary medium. Rotary power source 10 may be any suitable rotary power source, such as, for example, a pneumatic, an electric or a hydraulic motor. Power cylinder 11 is illustrated as being secured to rotary power source 10 by means of a mounting band 12, although any conventional means of securing cylinder 11 to rotary power source 10 may be employed. Rotary power source 10 is provided with a means 16, such as, a generally cylindrical spindle, for transferring rotary power. The spindle is preferably screw threaded and mated with the threaded internal diameter of one end of a fluid conducting tube 20. A generally cylindrical plug 22 which seals against high pressure fluid leakage is positioned within tube 20 and abuts means 16. Plug 22 is held therein by means of, for example, annular shoulder 25 formed along the inner diameter of tube 20. Plug 22 has an annular O-ring 23 inserted in a circumferentially extending groove which prevents fluid leakage from the interior of tube 20 to means 16. Drill tube 20 is further provided with a plurality of ports 27, the purpose of which will be hereinafter described. The side feed, swivel flow divider of the present invention is illustrated generally as 30 in FIG. 1. Swivel flow divider 30 is a generally hollow, cylindrical member and is sized to receive tube 20 therethrough in a manner hereinafter described. Swivel flow divider 30 is provided with an annular recess 32 in the internal diameter thereof, which is generally centered along the longitudinal length thereof, and which defines a first annular seal bearing 31 and a second annular seal bearing 33. Swivel flow divider 30 is further provided with a threaded inlet 34 along the length thereof to which a source of fluid may be connected. Threaded inlet 34 communicates with recess 32 and is preferrably centered along the length of swivel flow divider 30. Swivel flow divider 30 is provided with at least one flushing port 36 therethrough which extends the entire length thereof to provide for fluid passage along the longitudinal length of the swivel flow divider 30. As illustrated in FIG. 2, swivel flow divider 30 may be provided with a plurality of flushing ports 36, uniformly spaced along the annular cross sectional configuration thereof. Swivel flow divider 30 is secured to a first generally annular collar 40 by any suitable means, such as by screws 42. An annular low pressure lip seal 44 is fixedly secured to the internal diameter of first collar 40 by any suitable means, such as by an interference fit. The outer periphery of first collar 40 is provided with circumferentially extending notch 46. Cylinder 11 is provided with a piston rod 14 having a threaded outer end. A nut 17 is mated with the threaded outer end of piston rod 14 and has an annular shoulder 18 integral therewith. When cylinder 11 is secured to rotary power source 10, annular shoulder 18 is movably positioned within annular groove 46 of first collar 40. As thus assembled, rotary power source 10 and cylinder 11 can be concurrently rotated about swivel flow divider 30 and first collar 40 as annular shoulder 18 is free to move within notch 46. A second collar 50 is secured to the other end of swivel flow divider 30 by any suitable means, such as by screws 52. An outer tube 54 may be fixedly secured to second collar 50 by any suitable means, such as by screw threads 47. Outer tube 54 is preferrably concentric with tube 20 and is sized to provide an annular fluid passage 56 therebetween. O-rings 51 and 57 are positioned between swivel flow divider 30 and second collar 50 and first collar 40, respectively, to seal against fluid leakage. O-rings 51 and 57 can be constructed from any suitable resilient sealant material, such as, rubber. Any suitable means can be employed to prevent fluid leakage through bore(s) 59, such as, for example, a resilient washer positioned between the head of screw(s) 53 and second collar 50 (not illustrated).

The diameters of first annular seal bearing 31 and second annular seal bearing 33 of swivel flow divider 30 are correspondingly uniformly tapered from the end of the swivel flow divider 30 which is secured to second collar 50 to the end of swivel flow divider 30 which is secured to first collar 40. The external diameter of tube 20 which may be in contact with first annular seal bearing 31 and second annular seal bearing 33 of swivel flow divider 30 is correspondingly tapered from the area of second collar 50 to the area of first collar 40.

In operation, a hose conducting fluid from a high pressure fluid source is mated at one end thereof (not illustrated) with threaded inlet 34. Fluid pumped at a constant rate of, for example, 3–6 gallons per minute flows through the hose into inlet 34 and recess 32. When cylinder 11 is actuated to extend piston rod 14, nut 17 and annular shoulder 18, first collar 40, swivel flow divider 30, second collar 50 and outer tube 54 are concurrently extended. Swivel flow divider 30 is extended away from the rotary power source 10, until the tapered internal surfaces of first and second annular seal bearings 31 and 33 abut the correspondingly tapered external surface of tube 20. In this extended position, substantially all of the fluid pumped through inlet 34 into recess 32 is forced through ports 27 by the abutting surfaces of seal bearings 31 and 33 and tube 20. The high pressure of the fluid forced within tube 20 is created by a restriction within tube 20, such as, for example, a high pressure fluid orifice positioned within tube 20 at a distance from swivel flow divider 30 (not illustrated in FIGS. 1 and 3). A small portion of the fluid will leak between the abutting surfaces of first and second annular seal bearings 31 and 33 of swivel flow divider 30 and tube 20 into a low pressure region and be directed in part by low pressure lip seal 44 which abuts tube 20 and flushing port(s) 36 into the annular fluid passage 56. The small amount of fluid transported via annular passage 56 provides a fluid bearing for the external surface of tube 20, and may be drawn off at any location and utilized in a manner which will be evident to the skilled artisan. Alternatively, fluid leaking between abutting surfaces of annular seal bearings 31 and 33 and tube 20 can be diverted back to the fluid source. When it is desired to reduce the flow of fluid through tube 20, pressure to cylinder 11 is reduced and the action of a return spring in cylinder 11 to fluid pressure in recess 32 causes swivel flow divider 30 to retract thereby increasing the gap between tube 20 and first and second annular seal bearings 31 and 33, and directing more fluid through passage 56. The relative amount and pressure of fluid directed through tube 20, and thus, annular passage 56 can be controlled by the pressure supplied to cylinder 11. Cylinder 11 can be pneumatically, electrically or hydraulically powdered. The control utilized for rotary power source 10 may also be utilized for cylinder 11 so that high pressure fluid is directed through tube 20 only when tube 20 is rotated.

High pressure fluid in recess 32 of swivel flow divider 30 acts upon the external, tapered surface of tube 20 to create an axial force which opposes the extension of cylinder 11. This axial force is proportional to the fluid pressure, the length of swivel flow divider 30 and the diameter and taper of tube 20 and seal bearings 31 and 33. The degree which annular seal bearings 31 and 33 and tube 20 are tapered will depend upon the extension force of cylinder 11, the dimensions of swivel flow divider 30 and tube 20 and the desired operating pressure of swivel flow divider 30. At operating pressures of up to about 10,000 to about 15,000 psi, the diameter of seal bearings 31 and 33 and the external diameter of tube 20 are correspondingly tapered in the range of from about 0.002 to about 0.010 inch diameter decrease per inch of length. At the same operating pressures, and, for example, when swivel flow divider 30 has a length of 2.5 inches, seal bearings 31 and 33 have a length of 0.5 inches, and tube 20 has a diameter of 0.75 inches and is tapered along a 4 inch length thereof, seal bearings 31 and 33 and tube 20 are preferably correspondingly tapered about 0.006 inch diameter decrease per inch of length divider 30 travels. An exemplary distance which swivel flow divider 30 can travel along tube 20 between extended and retracted positions is about 1 inch which will create a gap between seal bearings 31 and 33 and tube 20 in the retracted position approximately equal to the taper.

It can thus be appreciated that the side feed, swivel flow divider of the present invention as assembled to a rotary power source transfers fluid at high pressure from a stationary media to a rotary media. The swivel flow divider of the present invention is relatively simple in construction thereby obviating the need for complex bearings and high pressure seals which are expensive and are constructed of materials such as, teflon and graphite, which tend to wear out in a relatively short period of time. Fluid movement between first and second seal bearings 31 and 33 and tube 20 reduces heat thereby improving the performance and prolonging the useful life of seal bearings 31 and 33. In addition, the swivel flow divider is assembled with a rotary power source in such a manner that the need for complex gearing to drive tube 20 is obviated.

The high pressure fluid apparatus of the present invention has application to oil well drilling, fluid jet cleaning, and transfer of lubricating, cooling, power, control or process fluids in rotating machinery and apparatus.

Figure 3:
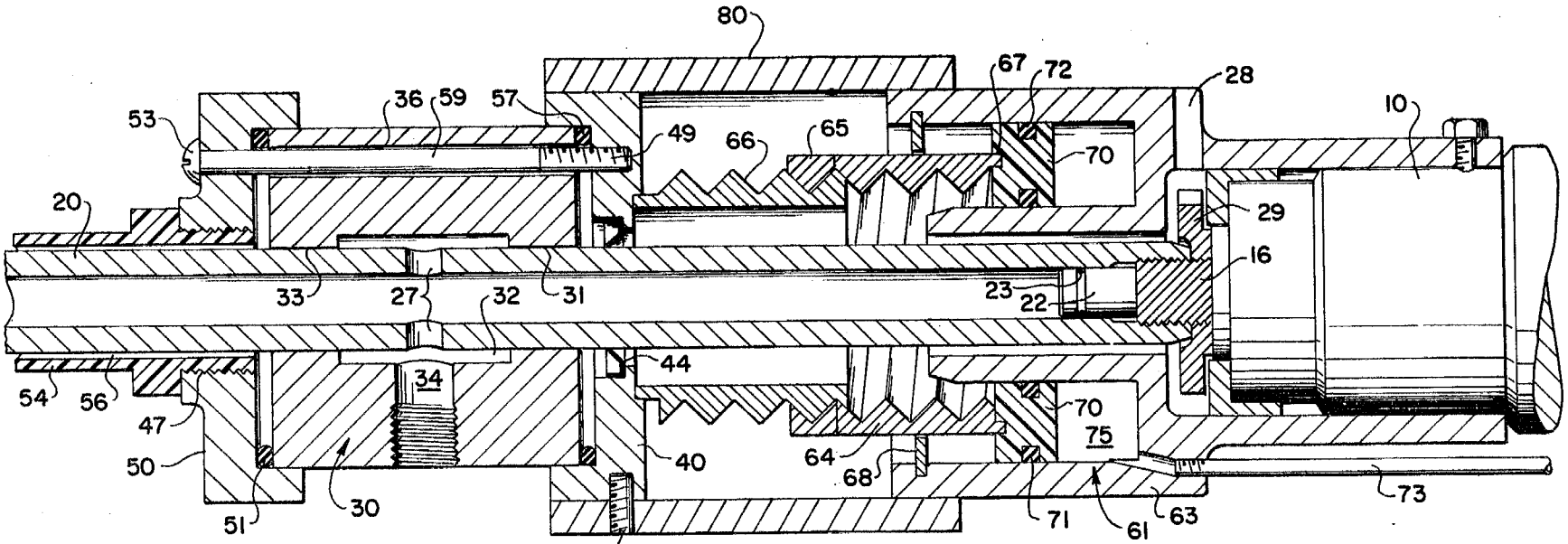
FIG. 3 is a sectional view of the swivel flow divider of the present invention as alternatively connected to a rotary power source and an accompanying power cylinder.

Referring now to FIG. 3, the swivel flow divider of the present invention is illustrated as alternatively connected to rotary power source 10 and an accompanying power cylinder, illustrated generally as 61. Swivel flow divider 30 is secured to first collar 40 and second collar 50 by means of a plurality of screws 53 (only one illustrated) which are inserted through bore 59 in second collar 50 and aligned flushing port 36 and are mated with threaded bore 49 which terminates within first collar 40. An alternative air cylinder 61 is positioned around tube 20 between swivel flow divider 30 and rotary power source 10. Air cylinder 61 comprises an annular piston sleeve 63 within which an annular piston 70 having an outer sealing ring 72 and an inner sealing ring 71 is positioned. A first connecting ring 64 is secured to piston 70 by any suitable means, such as, by annular tab 67 which is press fitted into an annular recess in piston 70. First connecting ring 64 is internally threaded, is mated with a second connecting ring 65 having external threads and is fixedly positioned with respect thereto by means of locking ring 66. An outer cover sleeve 80 is fixedly secured to the outer periphery of first collar 40 by any suitable means, such as by set screw 82 mated with a threaded bore in the outer periphery of first collar 40. Cover sleeve 80 is sized to be slidingly received around the outer peripheral surface of piston sleeve 63. The annular space 75 between piston 70 and piston sleeve 63 is provided with a source of fluid pressure via conduit 73. An aperture 28 may be provided behind piston sleeve 63 to provide tool access to spindle nut 29 thereby permitting the spindle to be unmated with tube 20 when nut 29 is secured against rotation by a suitable tool and tube 20 is rotated in a counter clockwise direction, for example, by manual rotation utilizing a suitable tool.

In operation, when it is desired to divert fluid pumped into inlet 34 and recess 32 into tube 20, fluid is supplied to annular space 75 via conduit 73 under sufficient pressure to extend piston 70, and thus, connecting rings 64 and 65, first collar 40 and swivel flow divider 30. If less fluid flow is desired through tube 20, the pressure of fluid supplied to annular space 75 via conduit 73 is reduced and fluid pressure acting within swivel flow divider 30 is sufficient to retract the swivel flow divider thereby increasing the gap between the correspondingly tapered first and second seal bearings 31 and 33 and tube 20. The extension of piston 70 is limited by any suitable means, such as, by annular snap ring 68. Threaded connecting rings 64 and 65 and locking ring 66 allow the distance between piston 70 and first collar 40 to be adjusted. Thus, the range of operating positions of swivel flow divider 30 can be varied.

The swivel flow divider and the assemblage utilized to secure the same to a power cylinder may be constructed of any suitable material. Preferrably, however, swivel flow divider 30 is constructed of bronze alloy which is conventionally utilized to construct bearings. First and second collars 40 and 50 are preferrably constructed of aluminum and outer tube 54 is preferrably a plastic, such as, polyvinyl chloride. Tube 20 is conventionally constructed of a steel alloy. Connecting rings 64 and 64 illustrated in FIG. 3 are preferrably constructed of a steel alloy or alumnium, piston sleeve 63 of aluminum, cover sleeve 80 of aluminum or plastic, such as polyvinyl chloride, and piston 70 of plastic. All low pressure sealing components of the present invention can be constructed of any suitable resilient sealant material, for example, rubber.

Figure 4:
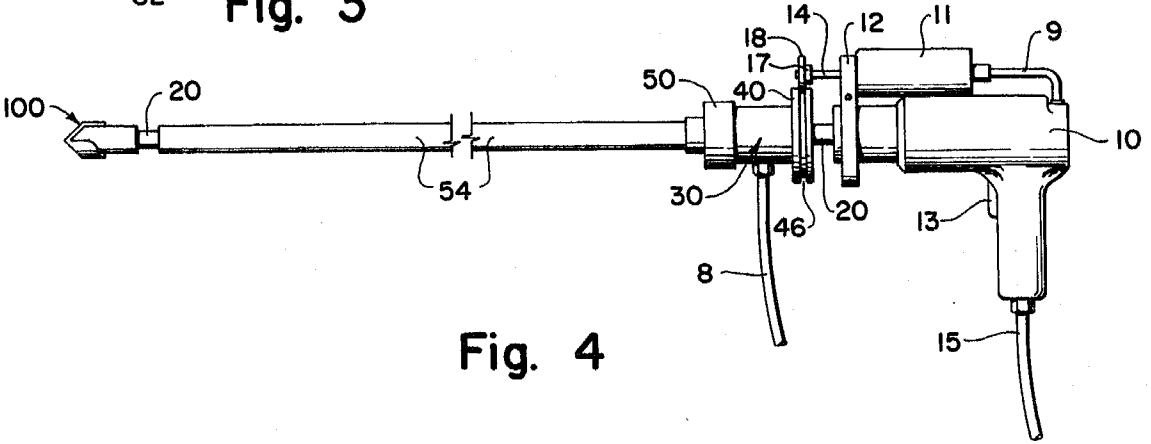
FIG. 4 is a perspective view of the swivel flow divider and fluid jet rotary bit of the present invention as assembled in a portable rotary rock drill.

The preferred application of the swivel flow divider of the present invention is in a portable rotary rock drill of the type utilized to drill relatively small diameter holes, such as for example, roof bolt holes, shot holes and exploratory holes. As illustrated in FIG. 4, swivel flow divider 30 is connected to a pneumatic rotary drill 10 in the manner illustrated in FIG. 1, as aforedescribed. Pneumatic rotary drill 10 is equipped with trigger 13 which may be manually manipulated to variably control the rotation transferred to drill rube 20. Air pressure is supplied to pneumatic motor 10 by means of a suitable hose 15. Cylinder 11 is supplied with pneumatic power by conduit 9, the pneumatic pressure being concurrently controlled by trigger 13. A second hose 8 supplies fluid pressure, for example, water pressure, to swivel flow divider 30 and may be screw threaded with inlet 34 or provided with a quick disconnect coupling as is evident ot the skilled artisan. The outer end of drill tube 20 is releasably secured to a fluid jet bit 100 which has a replaceable carbide insert and a plurality of fluid jets to augment the cutting action thereof. The end of outer tube 54 is juxtaposed to drill bit 100 to transport adequate flushing fluid during drilling, as hereinafter described. It is important to note that swivel flow divider 30 may be connected to pneumatic rotary drill 10 in the manner illustrated in FIG. 3, as aforedescribed. Further, pneumatic rotary drill 10 and cylinder 11 may alternatively be hydraulic or electric.

In operation, an individual operator can manually manipulate trigger 13 and concurrently hold outer tube 54 so as to guide bit 100. The operator gradually depresses trigger 13 to rotate drill tube 20 and bit 100 via pneumatic motor 10 while positioning swivel flow divider 30 via cylinder 11 so as to direct liquid flow to the fluid jets in bit 100. The pressure of the fluid directed within drill tube 20 is relatively high due to the flow restriction created by the fluid jets in bit 100. While gradually depressing trigger 13, the operator simultaneously collars the hole to be drilled by manually gruiding the bit via outer tube 54 and manually supplying the requisite drilling thrust, for example, 10–50 pounds. The resultant reactive drilling torque, for example, 5 ft.-lbs., can be easily withstood by the operator. As pneumatic motor 10 and a cylinder 11 are controlled by trigger 13, maximum jet pressure coincides with maximum bit rotation. Once the hole is drilled or if bit 100 becomes stuck, trigger 13 is released, bit rotation ceases and liquid flow is directed from the interior of drill tube 20 and the fluid jets in bit 100 to fluid passage 56. Thus, fluid is transported via fluid passage 56 to the area of bit 100 so as to flush cuttings from the area of the bit and suppress dust. In this manner, the operator of the portable rock drill is provided with a positive, simultaneous cut off of rotary power and hydraulic jet pressure to bit 100 which serves to increase safety of the operation of the drill, as well as to facilitate bit removal from the drill hole.

A portable rotary rock drill which is equipped with the swivel flow divider of the present invention is light weight, e.g. less than 20 pounds, is relatively noiseless and results in extremely quick penetration of soft to medium hard rock, such as sandstone. Additionally, the portable rotary drill is easily maneuvered by the operator, as the rotary power source 10 and cylinder 11 can be rotated about the swivel flow divider 30 to, inter alia, allow drilling in a limited working area, or enable the operator to exert the thrust necessary to penetrate a given strata. Further, a portable rotary bit equipped with a swivel flow divider can be utilized to create slots or create subterranean rooms by first creating aligned slots, and subsequently wedging or blasting to fracture the strata therebetween.

Figure 7:
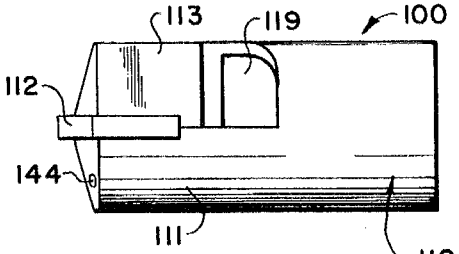
FIG. 7 is a side view of the fluid jet rotary bit of the present invention.
Figure 5:
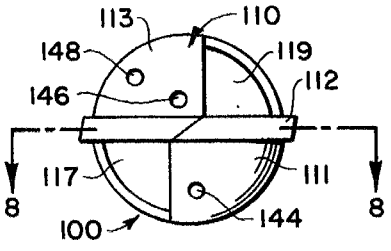
FIG. 5 is a front view of the fluid jet rotary bit of the present invention.
Figure 6:
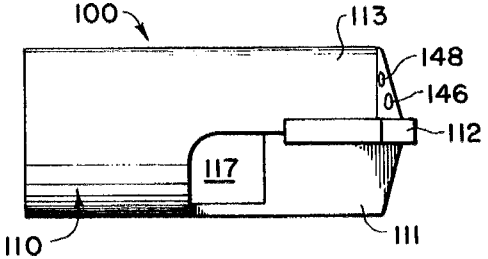
FIG. 6 is a side view of the fluid jet rotary bit of the present invention.

Fluid jet bit 100, illustrated generally in FIGS. 5, 6, and 7, may be secured to the end of any suitable rotary drill tube. Bit 100 has a wear resistant insert 112, such as, a tungsten carbide insert, secured to the leading end thereof by any suitable means, such as, for example, by brazing. Insert 112 serves to mechanically fragment rock strata during rotary drilling operations. Bit body 110 is a generally hollow, cylindrical member which is partially cut away as at 117 and 119 so as to define opposed, protruding portions 111 and 113 which support insert 112 therebetween. The outer ends of portions 111 and 113 are tapered toward insert 112. A plurality of fluid jet exit apertures are provided through portions 111 and 113 for passage of high pressure fluid jets therethrough, as hereinafter described. As illustrated, portion 111 is provided with an exit aperture 144 and portion 113 with a pair of exit apertures 146 and 148. Exit aperture 146 is angled, for example, at 2° from the longitudinal axis of bit 100 so that the fluid jet emanating therefrom during rotational drilling will cut a central annular kerf or slot in the rock strata drilled. Apertures 144 and 148 are angled, for example, at 14° and 24° respectively from the longitudinal axis of drill bit 100, so that fluid jets emanating therefrom during rotational drilling will cut concentric kerfs or slots around the kerf cut by the fluid jet emanating from aperture 144 in the rock strata drilled. The exact number of exit apertures utilized in portions 111 and 113, the allocation thereof between portions 111 and 113, and the degree each aperture is angled with respect to the longitudinal axis of bit 100 may be varied depending on, inter alia, the rock strata drilled, the hole diameter and the pressure available to the fluid jets as will be evident to the skilled artisan. In general, the annular kerfs or slots formed in the rock strata by high velocity fluid jets emanating from the exit apertures aid insert 112 in fragmenting the rock strata.

Figure 8:
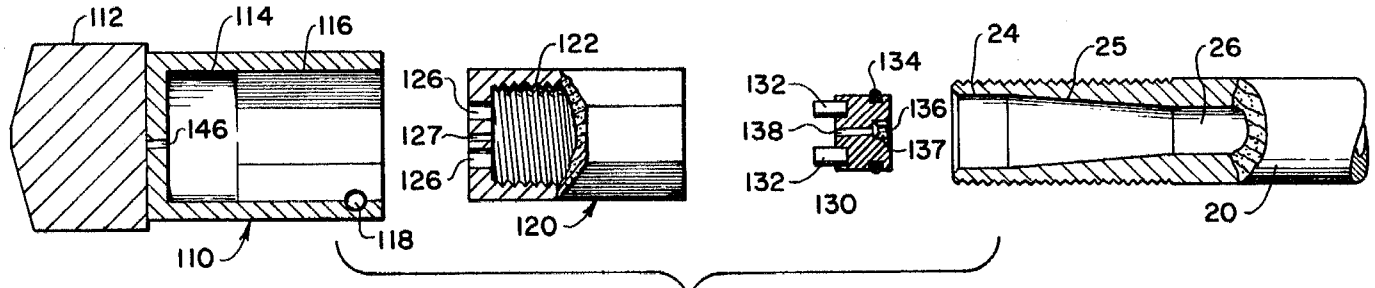
FIG. 8 is an exploded, sectional view of the fluid jet rotary bit of the present invention juxtaposed to a rotary drill tube and taken along line 8—8 of FIG. 5.

Referring now to FIG. 8, the component parts of the fluid jet rotary bit 100 of the present invention are illustrated in relation to drill tube 20. Bit 100 has a bit body 110, a fluid jet housing 120 and a fluid jet mounting 130. Bit body 110 has a wear resistant insert 112 secured to the outer end thereof as aforedescribed. Bit body 110 has a bore 116 through the other end thereof which terminates within bit body 110. Bore 116 preferrably has a substantially polygonal cross sectional configuration corresponding to that of bore 116 in body 110 and is sized to be received within bore 116 in a sliding manner. Fluid jet housing 120 has a screw threaded bore 122 through one end thereof and a pair of spaced apart apertures 126 through the other end thereof which communicate with bore 122. A plurality of fluid jet apertures (only one of which is illustrated as 127 in FIG. 8) are provided through the other end of fluid jet housing 120 and angled as aforedescribed.

Fluid jet mounting 130 is sized and peripherally configured to be received within a bored section 24 of drill tube 20 and has a pair of pins 132 fixedly secured thereto, in a spaced apart manner, by any suitable means. A resilient O-ring 134 is positioned within an annular groove in the outer periphery of mounting 130. One of a plurality of saphire orifices 136 is positioned within one of a plurality of bores 137 in one end of mounting 130. A second bore 138 in the other end of mounting 130 communicates with bore 137 and is angled as aforedescribed.

Drill tube 20 has a screw threaded outer diameter at one end thereof and the inner diameter thereof has a bored section 24, a tapered bored section 25 and a passage 26 having a smaller diameter than the first bored section and extending substantially the entire length of drill tube 20, so as to define a fluid passageway.

Figure 9:
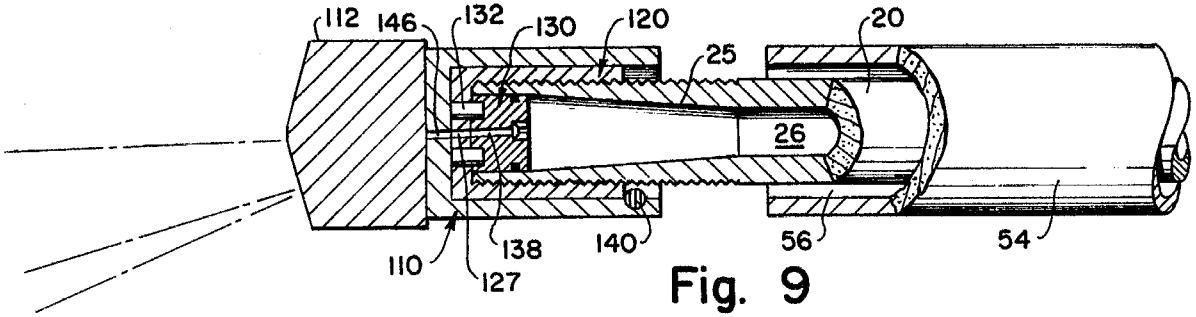
FIG. 9 is a sectional view taken along line 8—8 of FIG. 5 of the fluid jet rotary bit of the present invention as assembled and secured to a rotary drill rube.

Fluid jet rotary bit 100 is illustrated in FIG. 9 as assembled to drill tube 20. As such, pins 132 of mounting 130 are inserted within apertures 126 of housing 120. Screw threaded bore 122 of housing 120 is fully mated with the external threads of drill tube 20 such that mounting 130 is received within bored section 24 of drill tube 20. Subsequently, bore 116 of bit body 110 is meshed with the outer periphery of housing 120 and a keeper pin 140 is inserted through each aperture 118 to releasably secure carbide bit 110 to housing 120. Thus, as the useful life of insert 112 is normally shorter than that of the saphire orifices 136, each keeper pin 140 can be removed from aperture 118 and used carbide bit 110 removed from housing 120 and either resharpened, or replaced at the drill site with a new bit body 110 without disturbing orifices 136 or O-ring 134 by subjecting the same to the drill site environment.

Fluid jet apertures 138, 127 and 146 are aligned when bit 100 is assembled, and as such, shield the fluid jet stream emanating from orifice 136 substantially the entire distance to the rock strata interface. Coupled with the fact that the fluid path formed by aligned apertures 138, 127 and 146 is a relatively short distance, e.g. approximately 1 inch, the fluid jet stream emanating from orifice 136 is prevented from decaying to any substantial extent prior to contacting the rock strata interface.

While various embodiments and modifications of this invention have been described in the foregoing description, further modifications will be apparent to those skilled in the art. Such modifications are included within the scope of this invention as defined by the following claims.

I claim:

1. An apparatus for transferring fluid from a stationary source into an elongated tube at a relatively high pressure, said elongated tube adapted to be rotated by a rotary power source, said apparatus comprising:

means for directing substantially all of said fluid from said stationary source into said tube at a location intermediate the length of said tube and at a relatively high pressure when said fluid directing means is in a first position and for directing substantially all of said fluid from said stationary source to a low pressure region juxtaposed to said tube when said fluid directing means is in a second position; and means for selectively and variably positioning said fluid directing means at and between said first and said second position, said positioning means being connected to fluid directing means.

2. The apparatus of claim 1 wherein said fluid directing means comprises:

a generally hollow, substantially cylindrical member sized to receive said elongated tube therethrough, said member having an annular recess formed in the internal diameter thereof, said recess defining a first annular seal bearing and a second annular seal bearing separated by said recess from said first annular seal bearing.

3. The apparatus of claim 2 further comprising:

a first generally annular collar secured to the end of said substantially cylindrical member where said first annular seal bearing is located.

4. The apparatus of claim 3 wherein the internal diameter of said cylindrical member is uniformly tapered from said second annular seal bearing to said first annular seal bearing and the outer diameter said elongated tube is correspondingly uniformly tapered.

5. The apparatus of claim 4 wherein said internal diameter of said cylindrical member and said outer diameter of said elongated tube are correspondingly tapered in the range of from about 0.002 to about 0.010 inch diameter decrease per inch of length.

6. The apparatus of claim 5 wherein said internal diameter of said cylindrical member and said outer diameter of said elongated tube are correspondingly tapered about 0.006 inch diameter decrease per inch of length.

7. The apparatus of claim 3 wherein said positioning means comprises:

a power cylinder connected to said first collar.

8. The apparatus of claim 7 wherein the outer periphery of said first collar has an annular notch therein and wherein said power cylinder comprises a rod extending outwardly therefrom and having a threaded outer end, a piston secured to the other end of said rod, and a member having a threaded bore therein mated with said threaded outer end of said rod and having an annular shoulder slidably positioned within said annular notch of said first collar.

9. The apparatus of claim 4 wherein said cylindrical member has at least one longitudinal bore therethrough to permit passage of low pressure fluid and has a threaded inlet bore therethrough which communicates with said recess, said inlet bore adapted to be connected to said fluid source.

10. The apparatus of claim 4 further comprising:

a second generally cylindrical collar secured to the end of said substantially cylindrical member where said second annular seal bearing is located; and a second elongated tube secured to said second collar and surrounding said first elongated tube so as to define an elongated annular fluid passage therebetween for conducting low pressure fluid.

11. The apparatus of claim 7 wherein said power cylinder comprises an annular piston sleeve, an annular piston slidably positioned within said piston sleeve, and an annular connecting ring having a first end secured to said annular piston and a second end contiguous to said first collar.

12. The apparatus of claim 11 wherein said annular connecting ring comprises a first annular portion having a threaded inner diameter, a second annular portion having a threaded outer diameter mated with the threaded inner diameter of said second annular portion, and means for releasably securing said first and second portions as mated.

13. The apparatus of claim 11 further comprising:

an annular ring secured to said annular piston sleeve to limit the movement of said piston therein.

14. The apparatus of claim 4 further comprising:

fluid jet orifices secured to said elongated tube.

15. A portable rotary rock drill for drilling relatively small diameter holes, such as, roof bolt holes, shot holes and exploratory holes, the rock drill supplied with fluid from a stationary source, said rotary rock drill comprising:

a rotary power source;

an elongated drill tube releasably secured to said rotary power source and adapted to be secured to a rock drill bit having fluid jet orifices;

means for directing substantially all of said fluid from said stationary source into said elongated drill tube at a location intermediate the length of said drill tube and at a relatively high pressure when said fluid directing means is in a first position and for directing substantially all of said fluid from said stationary source to a low pressure region juxtaposed to said elongated drill tube when said fluid directing means is in a second position; and means for selectively and variably positioning said fluid directing means at and between said first and said second position.

16. The rotary rock drill of claim 15 wherein said fluid directing means comprises:

a generally hollow substantially cylindrical member receiving said elongated drill tube therethrough, said member having an annular recess formed in the internal diameter thereof, said recess defining a first annular seal bearing and a second annular seal bearing separated by said recess from said first annular seal bearing.

17. The rotary rock drill of claim 16 further comprising:

a first generally annular collar secured to the end of said substantially cylindrical member where said first annular seal bearing is located.

18. The rotary rock drill of claim 17 wherein the internal diameter of said cylindrical member is uniformly tapered from said second annular seal bearing to said first annular seal bearing and the outer diameter said elongated drill tube is correspondingly uniformly tapered.

19. The rotary rock drill of claim 18 wherein said internal diameter of said cylindrical member and said outer diameter of said elongated drill tube are correspondingly tapered in the range of from about 0.002 to about 0.010 inch diameter decrease per inch of length.

20. The rotary rock drill of claim 19 wherein said internal diameter of said cylindrical member and said outer diameter of said elongated drill tube are correspondingly tapered about 0.006 inch diameter decrease per inch of length.

21. The rotary rock drill of claim 17 wherein said positioning means comprises:

a power cylinder secured to said rotary power source and connected to said first collar.

22. The rotary rock drill of claim 21 wherein the outer periphery of said first collar has an annular notch therein and wherein said power cylinder comprises a rod extending outwardly therefrom and having a threaded outer end, a piston secured to the other end of said rod, and a member having a threaded bore therein mated with said threaded outer end of said rod and having an annular shoulder slidable positioned within said annular notch of said first collar.

23. The rotary rock drill of claim 21 wherein said power cylinder comprises an annular piston sleeve, an annular piston slidably positioned within said piston sleeve, and an annular connecting ring having a first end secured to said annular piston and a second end contiguous to said first collar.

24. The rotary rock drill of claim 23 wherein said annular connecting ring comprises a first annular portion having a threaded inner diameter, a second annular portion having a threaded outer diameter mated with the threaded inner diameter of said second annular portion, and means for releasably securing said first and second portions as mated.

25. The rotary rock drill of claim 24 further comprising:

an annular ring secured to said annular piston sleeve to limit the movement of said piston therein.

26. The rotary rock drill of claim 18 wherein said cylindrical member has at least one longitudinal bore therethrough to permit passage of low pressure fluid and has a threaded inlet bore therethrough which communicates with said recess, said inlet bore adapted to be connected to said fluid source.

27. The apparatus of claim 18 further comprising:

a second generally cylindrical collar secured to the end of said substantially cylindrical member where said second annular seal bearing is located; and a second elongated tube secured to said second collar and surrounding said elongated drill tube to define an elongated annular fluid passage therebetween for conducting low pressure fluid.

28. The portable rotary rock drill of claim 21 wherein said rotary power souce and said power cylinder are pneumatic.

29. The portable rotary rock drill of claim 28 wherein the pneumatic power to said rotary power source and said power cylinder is commonly controlled.

* * * * *